US007132018B2

(12) United States Patent
Wood et al.

(10) Patent No.: US 7,132,018 B2
(45) **Date of Patent: *Nov. 7, 2006**

(54) MAGNETIC CORE INSULATION

(75) Inventors: Richard Wood, Blue Jay, CA (US); Richard Lathlaen, San Diego, CA (US)

(73) Assignee: Magnetic Metals Corporation, Camden, NJ (US)

( * ) Notice: Subject to any disclaimer, the term of this patent is extended or adjusted under 35 U.S.C. 154(b) by 264 days.

This patent is subject to a terminal disclaimer.

(21) Appl. No.: 10/424,966

(22) Filed: Apr. 28, 2003

(65) Prior Publication Data

US 2003/0209287 A1 Nov. 13, 2003

Related U.S. Application Data

(62) Division of application No. 09/315,549, filed on May 20, 1999, now abandoned.

(51) Int. Cl.
*H01F 1/12* (2006.01)
*C23C 28/00* (2006.01)
*B05D 5/12* (2006.01)

(52) U.S. Cl. ..... 148/122; 148/276; 427/127

(58) Field of Classification Search ..... 148/112, 148/113, 121, 122, 276, 284, 287; 427/127; 29/605, 609

See application file for complete search history.

(56) References Cited

U.S. PATENT DOCUMENTS

| | | | | |
|---|---|---|---|---|
| 2,543,710 | A * | 2/1951 | Schmidt et al. | 148/287 |
| 3,259,526 | A * | 7/1966 | Walker et al. | 148/280 |
| 4,314,594 | A * | 2/1982 | Pfeifer et al. | 148/304 |
| 4,496,401 | A * | 1/1985 | Dawes et al. | 148/217 |
| 4,504,327 | A * | 3/1985 | Inomata et al. | 148/304 |
| 4,596,611 | A * | 6/1986 | Dawes et al. | 148/217 |
| 5,800,635 | A * | 9/1998 | Collins et al. | 148/304 |
| 6,663,728 | B1 * | 12/2003 | Manhardt et al. | 148/430 |

FOREIGN PATENT DOCUMENTS

| | | | | |
|---|---|---|---|---|
| JP | 57-169207 | * | 10/1982 | 148/304 |
| JP | 61-163208 | * | 7/1986 | 148/286 |
| JP | 61-183454 | * | 8/1986 | 148/101 |

OTHER PUBLICATIONS

English translation of Japanese Kokai Patent Application No. Sho[1986]-183454 (Sawa et al., Japanese language document cited above).*

Handbook of Chemistry and Physics, 54th Edition, 1973, p. D-114.*

* cited by examiner

*Primary Examiner*—John P. Sheehan
(74) *Attorney, Agent, or Firm*—Philip O. Post

(57) ABSTRACT

Disclosed herein is an insulating material between adjacent metal layers of a soft magnetic core, and a process for forming this insulating material. The insulating material is composed of the native metal oxides of the metallic core material.

10 Claims, 5 Drawing Sheets

MAGNETIC CORE INSULATION

CROSS REFERENCE TO RELATED APPLICATIONS

This application is a division of U.S. application Ser. No. 09/315,549, filed May 20, 1999, now abandoned, which is hereby incorporated herein by reference.

FIELD OF THE INVENTION

The present invention generally relates to a method of providing insulation between adjacent metal layers of a magnetic core and to soft magnetic cores produced by this method. In particular, the present invention relates to the formation and use of native metal oxides between adjacent metallic magnetic core layers as insulation between the layers to restrict electrical current flow.

BACKGROUND OF THE INVENTION

Magnetic materials come in at least two forms, hard or soft. Hard magnetic materials are permanent magnets, which retain their magnetic properties after an energizing field is removed. An example of a hard magnetic material is a common refrigerator magnet. In contrast, soft magnet materials have a magnetic field which collapses after the energizing field is removed. Examples, of soft magnetic materials include electromagnets. Soft magnetic materials are widely used in electric circuits as parts of transformers, inductors, inverters, switch power supplies, and other applications. Soft magnetic materials are also used to make magnetic cores that provide high-energy storage, fast energy storage and efficient energy recovery. In these and other applications, magnetic cores may be used at a variety of different operational frequencies, typically ranging from 400 Hz to 20 kHz or more.

Most magnetic cores are made by winding a very thin magnetic metal strip or ribbon tightly around a substrate to form a multi-layered laminate. The wound metallic core is then subjected to a heating step, known as "annealing," to optimize its performance through heat-induced ordering of the magnetic domains in the metal. After the annealing step, the substrate may be removed and the magnetic core may be treated with binding agents to hold the adjacent metal layers together so that the core will not unwind. As known to those of skill in the art, such binding agents may include epoxies, having either one or two parts, such as Hysol #4242 resin and #3401 hardener (Olean, N.Y.), or #2076 impregnation epoxy by Three Bond Co. Treatment with a binding agent also permits the core to be processed by cutting to form C or E cores, so named because the resulting cut cores resemble a C or an E, as known to those of skill in the art.

The metal strips or ribbon layers making up a magnetic core are very thin, typically from about 0.01 to 0.3 millimeters thick. For high frequency applications of greater than 400 Hz, the individual metal layers of a wound magnetic core must also be electrically insulated from one another for the core to function properly. Without such insulation, at high frequency the magnetic core has electrical properties similar to a large metal block, and will experience large power losses due to eddy currents.

To provide insulation between layers, the prior art generally teaches coating the metal ribbon with an insulating material prior to winding the ribbon to form the core. The insulating material is typically coated on both sides of the ribbon, and functions to insulate the metal layers in the wound laminate from adjacent metal layers. One widely used coating method is described in U.S. Pat. No. 2,796,364 to Suchoff, which discloses a method of forming a layer of magnesium oxide on a metal ribbon surface as an insulating layer. As described in Suchoff, magnesium methylate is dissolved in an organic solvent, and the solution is applied to the metal ribbon surface. The metal ribbon is then heated to high temperature to form a strongly adherent magnesium oxide insulating film over the surface of the metal ribbon. The metal ribbon may then be wound to form the magnetic core.

There are several known disadvantages to the magnesium methylate process. First, the magnesium methylate must be applied to the metal ribbon before it may be wound into a core. Uncoiling the metal ribbon, dipping the ribbon into a bath to form the coat, heating and curing the coat, and winding the ribbon to form the core make the process slow and expensive. The magnesium methylate process is therefore not suitable to provide insulation to magnetic cores in low cost, high volume applications. Second, it is very difficult to control the thickness of the resulting magnesium oxide insulating layer. This presents a problem for certain magnetic core applications, such as pulse cores, which have high performance specifications that are difficult to achieve unless the coated magnesium methylate layer is very thin. Forming thin magnesium methylate coatings requires special processing that is very slow and difficult to control. Use of the magnesium methylate process for these applications is extremely expensive, and the resulting cores are fragile. Furthermore, even for applications where a thicker insulating layer is acceptable, valuable magnetic core space is taken up when excessive nonconductive insulating material is present. This reduces the space factor of the laminated stack so that the percentage of the core occupied by magnetic material is lessened along with the efficiency of the core. Finally, because the magnesium methylate must be coated before the annealing step, it may also interfere with the ordering of magnetic domains during annealing by inducing stress buildup between the coating and the soft magnetic material.

The magnesium methylate process also cannot be used to form insulating layers for certain types of magnetic cores. High temperatures are required to properly cure the magnesium methylate on the metal ribbon. Typically, the magnesium methylate coating must be heated to temperatures of at least 1550° F. or more to form a magnesium oxide film which firmly adheres to the metal ribbon. However, some soft magnetic materials, such as amorphous metal alloys, may not be heated to temperatures greater than about 840° F. without destroying their desirable magnetic properties. When magnesium methylate is used as an insulating material for these types of metal alloys, it is heated to much lower temperatures, and the resulting magnesium oxide layer is only loosely bound to the metal ribbon. As a result, these types of cores may not be cut to form C or E cores, because the stressful cutting operation will cause the loosely bound insulating coatings to delaminate. Only uncut cores such as toroids can be formed from amorphous metal alloys coated with the magnesium methylate process. Moreover, the present inventors know of no prior art coating process which may be used to form C or E magnetic cores of amorphous metal alloys.

Thus, there is a need for improved methods of forming thin dielectric insulation on soft magnetic metal ribbons used to make magnetic cores. There is also a need for an insulation which permits processing of amorphous metal cores to form C and E cores that can be used at high frequencies.

BRIEF SUMMARY OF THE INVENTION

The present invention advantageously overcomes the shortcomings of the prior art by providing a process to form insulating layers between adjacent metal layers of a magnetic core after the core has been wound. The process may be used to provide insulation to a wide variety of metals and metal alloys used to make magnetic cores, including amorphous metal alloys. The insulating material formed by the process of the present invention is firmly bound to the surface of the metal ribbon forming the core, and cores incorporating the insulating material may be cut to form C or E cores, or other cut cores known to those of skill in the art. Consequently, for the first time, C and E cores can be made which are formed of amorphous metal alloys and are suitable for high frequency applications.

In one aspect of the present invention, there is a method of providing dielectric isolation between adjacent metal layers of a laminated magnetic assembly. The method comprises a first step of oxidizing a laminated magnetic assembly, where the assembly is a plurality of layers which are formed in part of iron. The oxidation produces a coating comprising a mixture of iron oxides. The resulting magnetic assembly has a resistivity of greater than about 60 ohm-cm. The oxidizing step may comprise exposing the plurality of layers to steam in the presence of oxygen at a temperature of at least 500° F. Preferably, the layers may be heated to a temperature of from about 500° F. to 765° F. When the layers are an amorphous metal alloy, it is preferred that the layers are heated to between about 670° F. and 695° F. Further, the pH of the feedwater of the steam may be adjusted to a pH of from about 8 to about 11 prior to exposing the layers to the steam. The pH may be adjusted by contacting the feedwater and a salt. The salt may be of the type that forms a hydrate of its associated ion. The salt may also be selected from the group consisting of calcium oxide, calcium hydroxide, calcium carbonate, magnesium oxide, magnesium hydroxide, and magnesium carbonate. In preferred embodiments of the method, the oxidized laminated magnetic assembly exhibits at least a 15% decrease in power loss at operational frequencies of 10 to 20 kHz in comparison to the magnetic assembly prior to exposure to steam and air.

In another aspect of the present invention, there is a method of making a dielectrically insulated soft magnetic assembly. The method comprises a first step of winding an amorphous metal alloy ribbon containing iron into a multilayered core. Then, the core is heated in the presence of water and oxygen to oxidize the iron of amorphous metal alloy ribbon to form a coating comprising oxides of iron. The coating is at least about 0.03 microns thick.

In another aspect of the present invention, there is provided a soft magnetic assembly comprising an elongate amorphous metal strip. The strip is at least about 40% iron. The strip has a first side and a second side. The first side has small protrusions and the second side is substantially smooth. The strip is wound to form a laminate such that the protrusions on the first side contact the smooth second surface. A coating comprising oxides of iron substantially covers the smooth second surface and at least a portion of the protrusions which contact the smooth second surface. The coating preferably has a thickness of 0.03 microns or more. In some embodiments, greater than 75% of the coating comprises iron (III) oxide and iron (IV) oxide. It is also preferred that the coated soft magnetic assembly have a resistivity of greater than 60 ohm-cm, more preferably greater than 100 ohm-cm, and most preferably greater than 300 ohm-cm.

In another aspect of the present invention, there is provided a dielectric insulating coating between contact points of adjacent metal layers of a soft magnetic assembly. The coating comprising primarily iron (III) oxide in sufficient amount to reduce power losses in the assembly by at least 15%. Preferably, the dielectric insulating coating is present in sufficient amount to reduce power losses in the assembly by at least 30%, and more preferably by at least 45%.

In another aspect of the present invention, there is provided a soft magnetic assembly with an insulative material between adjacent metal layers of the assembly, the coating consisting essentially of oxides of iron, the assembly having a resistivity of at least 100 ohm-cm.

In another aspect of the present invention, there is a method of forming an insulative coating on the surface of an amorphous metal alloy strip. The method comprises providing an amorphous metal alloy strip in which the percentage of iron exceeds the percentage of any other element present in the alloy. Then, the strip is heated to a temperature at which the alloy anneals. The strip is then exposed to steam in the presence of oxygen to form a coating of oxides of iron over a substantial portion of the strip. Optionally, the strip may be wound into a core prior to heating the strip to the annealing temperature.

In another aspect of the present invention, there is provided a magnetic C core. The core has a plurality of amorphous metal alloy strips forming a laminate which are semicircular, semi-oval or semi-rectangular in shape. A metal oxide insulating coating is between adjacent strips within the laminate. The oxide is formed from the oxidation of iron. The insulative coating reduces power losses in the core by at least 15% when the core is used at operational frequencies of 10 kHz or more.

DETAILED DESCRIPTION OF THE INVENTION

The present invention generally relates to native metal oxide insulating compositions which may be formed on magnetic cores after the cores have been wound. Although described below in the context of a wound toroidal magnetic core, it should be readily appreciated by those of skill in the art that the teachings of the present inventon can be applied to magnetic cores having a variety of shapes and dimensions. For example, the present invention may be readily applied as part of a process to form C magnetic cores, E magnetic cores, and other laminated magnetic assemblies known to those of skill in the art. Furthermore, the invention can be applied to magnetic assemblies which comprise laminates which have not been wound, as for example, forming a magnetic laminate assembly by stacking successive layers.

Figure 1:
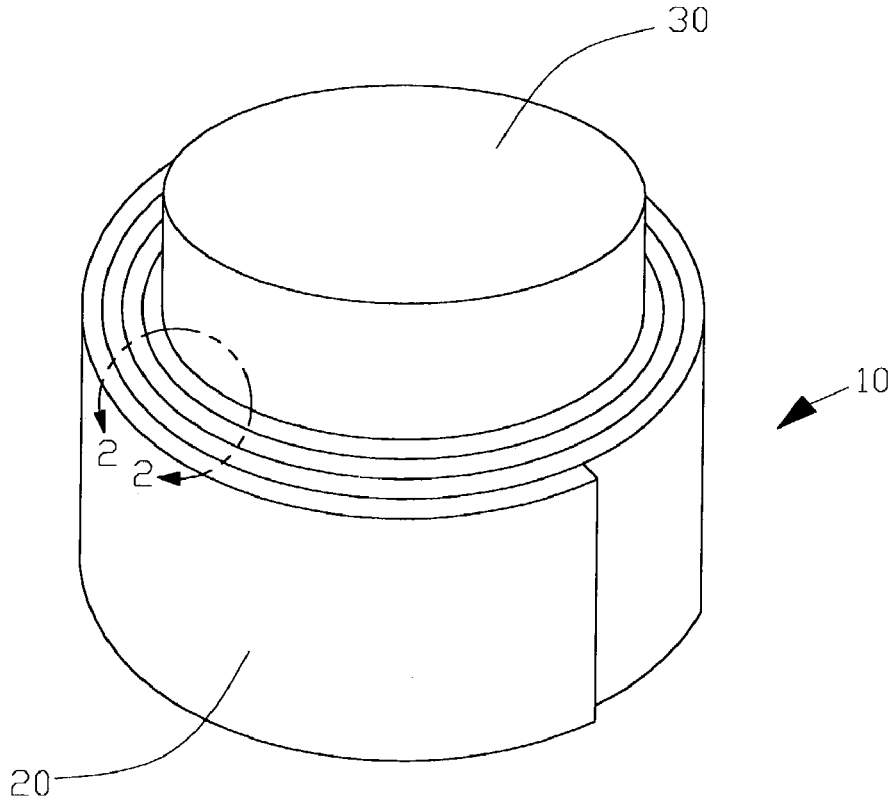
FIG. 1 is a schematic perspective view of a toroidal magnetic core.

Referring to FIG. 1, there is depicted a schematic of a wound toroidal magnetic core 10 incorporating the present invention. Magnetic core 10 is formed by winding a thin metal strip or ribbon 20 around a mandrel 30 to form a laminate. Mandrel 30 is merely a hard solid substrate around which the ribbon is wound, such as an elongated metal bar or rod. Mandrel 30 is removed in subsequent core processing, and is not part of the final magnetic core 10. Mandrel 30 may have various sizes and shapes such as round, rectangular, square, etc., which can be selected to form cores having differing shapes and dimensions. Metal ribbon 20 is wrapped around mandrel 30 a sufficient number of turns to form a multi-layered laminate of the desired aggregate thickness. For purposes of the present invention, ribbon 20 may be wound to form cores similar in size, dimension and weight to those now commercially available. After winding is complete, the wound core 10 may be annealed to optimize its performance, as known to those of skill in the art.

Figure 2:
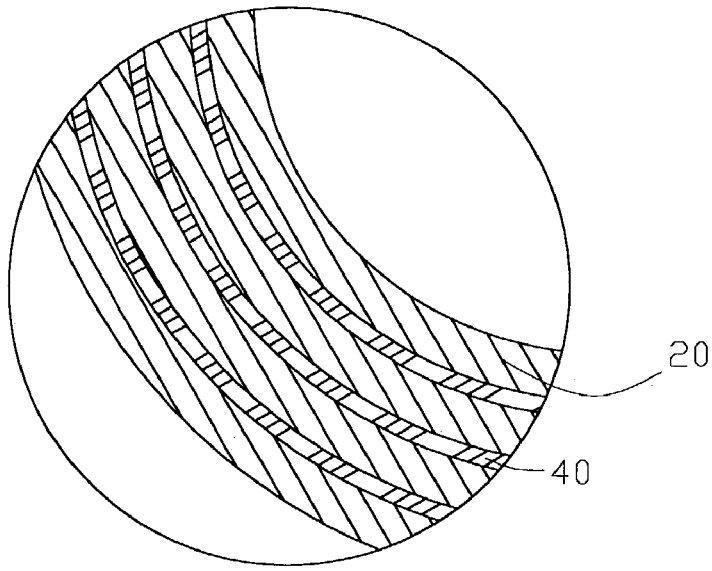
FIG. 2 is a schematic cross sectional view of the magnetic core of FIG. 1.

Metal ribbon 20 is a soft magnetic metal or alloy having iron as the dominant metal. Metal ribbon 20 is preferably thin, ranging from about 0.01 millimeters to 0.3 millimeters in thickness. Metal ribbon 20 may also vary in width from about 0.1 cm to about 50 cm. To minimize power losses at high frequencies, an insulating material 40 is provided between adjacent layers of metal ribbon 20. As shown schematically in FIG. 2, core 10 has a coating of insulating material 40 between alternating layers of metal ribbon 20. Insulating material 40 is formed at least on some of those portions of the layers of metal ribbon 20 which contact adjacent metal layers, and therefore restricts electrical current flow between adjacent metal layers.

Advantageously, the present invention provides a unique process which can be used to form insulating material 40 between adjacent metal layers of ribbon 20 after ribbon 20 has been wound into core 10. Thus, the time consuming and expensive coating processes of the prior art may be avoided. Furthermore, the unique insulating material 40 of the present invention is thin and is firmly adhered to ribbon 20. Thus, when insulating material 40 is formed on a magnetic core made of an amorphous metal alloy, the core may be cut to form soft magnetic assemblies previously unavailable, such as C and E cores of amorphous metal alloys.

Generally, insulating material 40 is formed by oxidizing metal ribbon 20 to form native metal oxides of the metals or alloy metals as a very thin coat overlying the surface of metal ribbon 20. The native metal oxides of most metals used to form cores have relatively high resistivities and are particularly suited to function as insulation between adjacent metal layers. Because most metals and metals in alloys which may form ribbon 20 may be oxidized to form a metal oxide having sufficient electrical resistance to form an adequate insulating material 40, the present invention is widely applicable to soft magnetic core materials used today. Table 1 sets forth representative examples of metals and metal alloys which may be used in the present invention, and the corresponding chemical composition of some of the insulating materials which may be created by oxidation of the metals or alloys.

TABLE 1

Partial listing of soft magnetic metals

| Elemental Metals | Approximate Alloy Composition | Trade Name | Native Metal Oxide Insulating Materials |
|---|---|---|---|
| Fe, Ni | 40% Fe, 38% Ni, 18% B, 4% Mo | METGLAS ® Alloy 2826MB | FeO, $Fe_2O_3$, $Fe_3O_4$ |
| Fe, B | 81% Fe, 13.5% B, 3% Si, 2% C | METGLAS ® Alloy 2605SC | FeO, $Fe_2O_3$, $Fe_3O_4$ |
| Fe, Co, Ni | T (70–80%), M (30–20%) | Amorphous and Nanocrystalline | FeO, $Fe_2O_3$, $Fe_3O_4$ |
| Fe, B | 70% Fe, 9% B, 3% Nb, 2% Cu, Mo, Co, Si | Nanocrystalline | FeO, $Fe_2O_3$, $Fe_3O_4$ |
| Fe, Co | 67% Fe, 18% Co, 14% B, 1% Si | METGLAS ® Alloy 2605CO | FeO, $Fe_2O_3$, $Fe_3O_4$ |
| | 49% Fe, 49% Co, 2% V | SUPERMENDUR ® | FeO, $Fe_2O_3$, $Fe_3O_4$ |

Where T = Fe, Co, Ni and M = B, C, Si.

Where iron is the dominant metal in the alloy, as for example in METGLAS® Alloy 2605SA1, the insulative material is formed primarily of iron (III) oxide ($Fe_2O_3$), with the remainder being mostly iron (IV) oxide ($Fe_3O_4$) and small amounts of iron (II) oxide (FeO). For example, for one core treated with steam and air at 690° F. for 6 hours, Raman spectroscopy revealed that the insulating layer was composed of approximately about 80 to 90% $Fe_2O_3$ and 10 to 15% $Fe_3O_4$, with small amounts of FeO. The layer had a thickness of 0.15 microns of this iron oxide mixture.

It should be appreciated by those of skill in the art that the representative alloys and metals set forth above are meant as illustrative examples, and the teachings of the present invention are applicable to iron dominant alloy compositions other than those described above. For example, the present invention can easily be applied to alloys which merely alter the compositional percentages, or alloys which introduce new metals or elements without affecting the ability of the iron-dominant alloy to be oxidized to form insulating iron oxides.

Insulating material 40 should be formed thick enough and have sufficient resistance to effectively insulate successive layers of metal ribbon 20 from electrical current flow between the layers. If the insulating metal 40 is formed too thick, however, the resulting magnetic core 10 will contain excessive nonconductive insulating material, and the magnetic core 10 will have a low space factor, i.e., the percentage of the magnetic core 10 occupied by magnetic material is low, reducing the efficiency of the core. Preferably, insulating material 40 is formed to have a thickness of between 0.01 and 5 microns, more preferably between 0.03 and 2 microns, and optimally between 0.03 microns and 0.5 microns. Of course, as should be appreciated by those of skill in the art, other thicknesses of insulating material 40 may be provided by varying the processing conditions described below. For example, where insulating material 40 is formed primarily of a metal oxide having a relatively high resistivity, thinner layers may be used to increase the space factor and core efficiency. Furthermore, for some applications, greater amounts of insulating material 40 may be desired between adjacent metal layers, such as for very high frequency and pulse power applications.

The electrical resistance of the laminate incorporating the present invention is a function of the resistivity of the metal oxide multiplied by the form factor of insulating material 40, combined with the marginal resistance created by the metal material of core 10. For most applications, it is preferred that core 10 have an effective resistivity of 60 Ω-cm and more preferably at least 100 Ω-cm and optimally at least 300 Ω-cm. Of course, as should be appreciated by those of skill in the art, the present invention can easily be adapted to create insulating material 40 having laminate resistivities greater or less than the described values, by varying the processing conditions described below.

In general terms, insulating material 40 is formed by controlled oxidation of the iron in metal ribbon 20. The presently preferred method of oxidation is to expose magnetic core 10 to steam in the presence of air (approximately 20% $O_2$) at elevated temperatures. The steam and air diffuse into wound core 10 and contact the surfaces of the heated layers of ribbon 20, resulting in accelerated oxidation of the surface of metal ribbon 20 to form a thin metal oxide coat or layer on the surface of metal ribbon 20. The steam and heat accelerate the electron transfer rate during some or all of the reactions from the metals of the ribbon alloy to oxygen, to form the iron oxides. The processing conditions can also be varied to further accelerate the electron transfer rate during some or all of the reactions, such as pH adjustments to the steam, or temperature increases to decrease steam particle size, as described more fully below.

Furthermore, as will be appreciated by those of skill in the art, different processing conditions which accelerate electron transfers between the metals and oxygen to form native metal oxides may be substituted for or supplement the steam/air combination. These alternate processing conditions may include exposing the laminated assembly to high concentrations of highly reactive oxidizing molecules such as ozone, nitrous oxide, and other highly reactive oxides of nitrogen. It is expected that if these highly reactive molecules are introduced in controlled manner in conjunction with the process described herein, reaction rates will be accelerated to form the insulating metal oxides.

Furthermore, for some applications, it may be desirable to form metal sulfides as the insulating material. To achieve this, hydrogen sulfide ($H_2S$) may be substituted for water in steam, to form native metal sulfides as the insulating layer of the present invention. Other analogues to oxygen and sulfur, such as selenium, might also be used as electron acceptors to form insulating compounds between adjacent metal layers.

Figure 3:
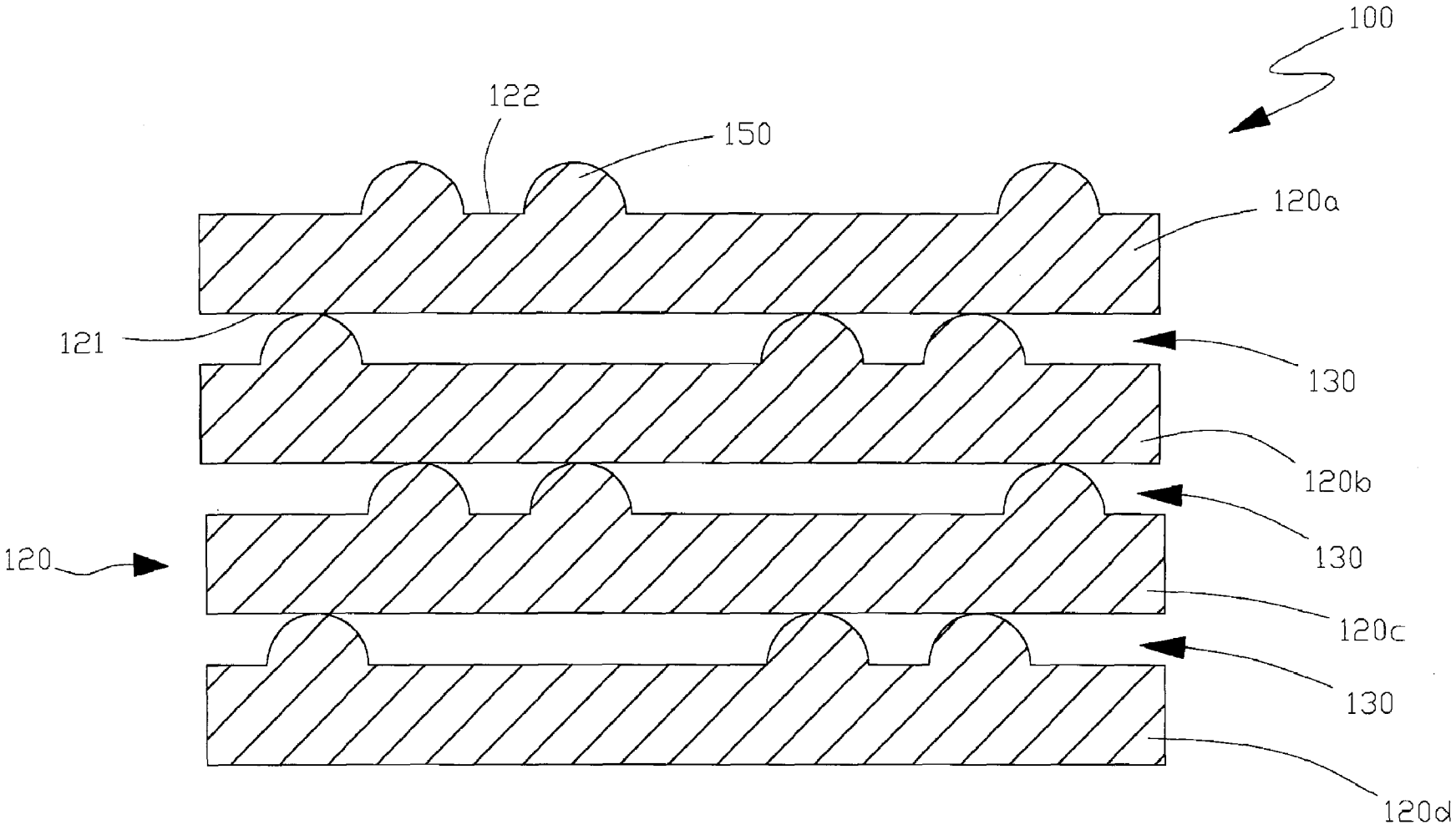
FIG. 3 is a schematic cross sectional diagram of an amorphous metal strip which has been wound to form a laminate, prior to formation of the insulating material of the present invention.

As can be readily appreciated, changes in the processing conditions or materials which facilitate complete and fast penetration of steam and air between all layers of heated laminated assembly such as core 10 will result in faster processing times and more uniform coats or layers of insulating material 40 on ribbon 20. The present inventors have found that the surface morphology of ribbon 20 can be selected to optimize diffusion or penetration of steam and air between layers. Referring to FIG. 3, there is shown a magnified view of a cross sectional portion of a wound core 100 formed of a soft magnetic material. Core 100 may be formed of any of the metals or alloys disclosed in Table 1, above, and variations thereof. Core 100 has multiple layers of metal ribbon 120, four of which, 120*a* through 120*d*, are depicted in FIG. 3. The adjacent metal layers 120*a* through 120*d* are not provided with an insulating material between them, and therefore readily conduct electric current flow at their points of contact. As shown in FIG. 3, ribbon 120 has a relatively smooth surface 121 and a rougher surface 122. Rougher surface 122 is characterized by protrusions or pips 150, which rise from the surface by a small distance in comparison to the thickness of layers 120*a* through 120*d* at scattered points on the rougher surface 122 of the metal ribbon 120. When ribbon 120 is wound to form a laminate, as depicted in FIG. 3, pips 150 contact the smooth surface 121 and thereby establish an electrical current flow path between adjacent metal layers 120*a* through 120*d*. A very small gap 130 is created between adjacent metal layers, defined approximately by the distance pips 150 rise from the surface. Advantageously, gap 130 provides a path which facilitates penetration of steam and air into the interior of wound core 100 during the process of the present invention.

Metal ribbons having the gaps and pips described above are commercially available as, for example, the amorphous metal alloys sold by Allied Signal Corporation under the trade name METGLAS®. For the METGLAS® ribbons, the differing surface morphologies of metal ribbon 120 are an artifact of the processing conditions used to create metal ribbon 120. The METGLAS® ribbons are formed by spraying molten metal alloys onto the surface of a rotating drum cooled with liquid chilling. The molten metal is cooled at a rate of about 1 million degrees per second. The alloys solidify before the atoms have a chance to segregate or crystallize. The resulting solid metal alloy has an amorphous glass-like atomic structure. The surface of the solid ribbon which contacted the drum is rougher because the rough drum surface introduces minor imperfections, which create pips 150.

Figure 4:
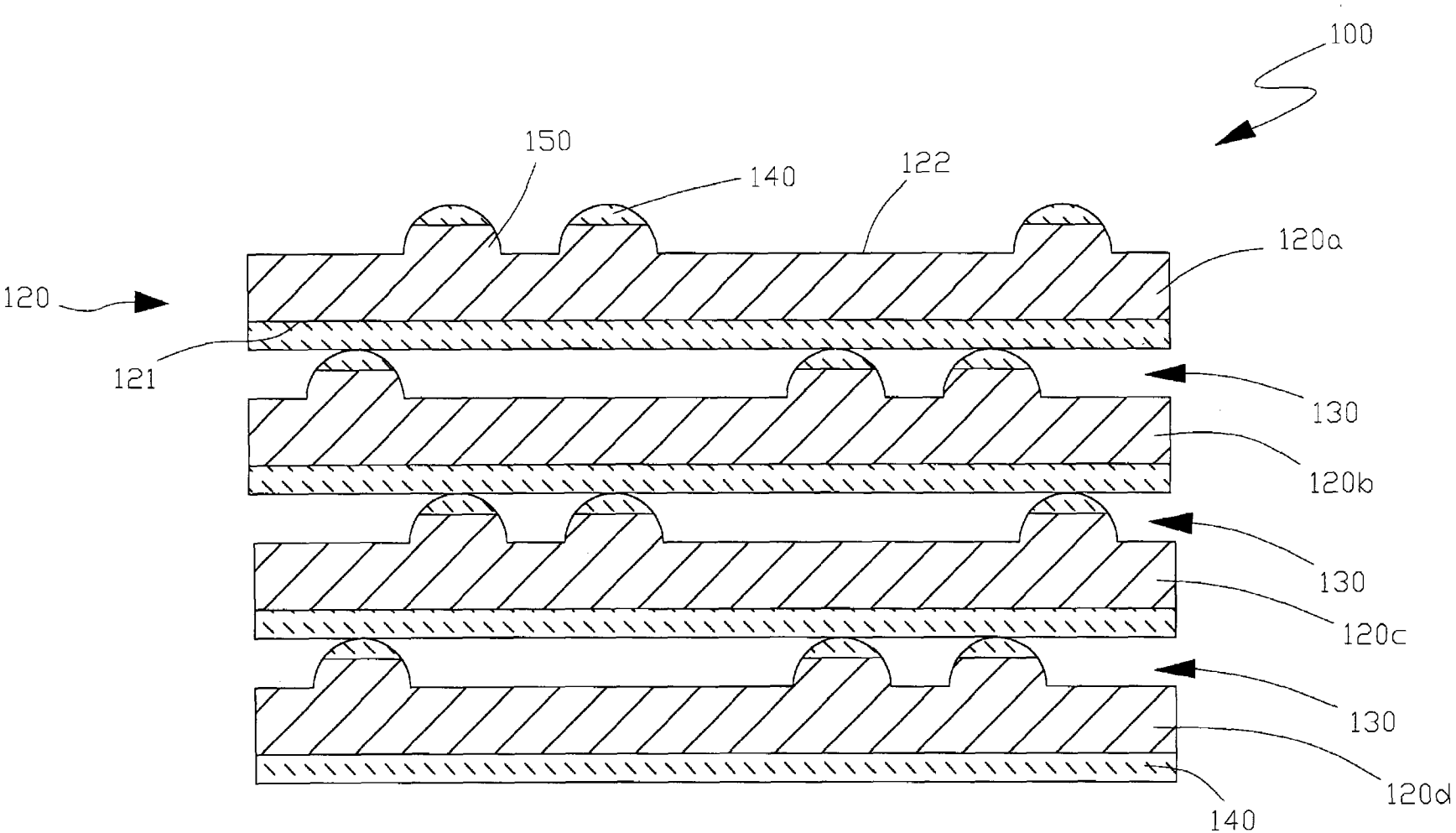
FIG. 4 is a schematic cross sectional diagram of an amorphous metal laminate of FIG. 3 featuring the metal oxide insulating material of the present invention.

Referring to FIG. 4, there is shown a schematic cross sectional diagram of the laminate of FIG. 3 which has been provided with insulating material 140 of the present invention. As shown in FIG. 4, a metal oxide material comprising insulating material 140 has been formed between adjacent layers 120*a* through 120*d*. Insulating material 140 is formed both on the relatively smooth surface 121 and on the rougher surface 122, and particularly covers pips 150. Insulating material 140 is positioned between metal contact points of adjacent metal layers 120*a* through 120*d*, and the electrical current paths previously present are substantially disrupted. As a result, the laminate is much more resistive to electrical current flow.

The presently preferred processing conditions to oxidize the metal to form the metal oxide insulating material are dependent on the core metals. For example, when an amorphous metal alloy of Fe/Si/C/B is being processed, it is preferred to heat the magnetic core to a temperature of 500° F. to 740° F., more preferably at a temperature of 550° F. to 720° F., and most preferably at a temperature of 670° F. to 690° F., and subject it to a mixture of steam and air. For amorphous metal alloys, good results have been achieved by heating the core to its annealing temperature, and simultaneously forming the metal oxide coating while annealing.

For most amorphous metal alloys, the annealing temperature is between 670° F. to 690° F., although several such alloys may have annealing temperatures outside of this range. The annealing conditions for the metal ribbon alloys used to make magnetic cores are well known to those of skill in the art. For example, the annealing conditions for amorphous metal alloys sold under the trademark METGLAS® are reported in Allied Signal's Advanced Materials Technical Bulletins.

It has been observed that the process of forming the insulating material is more efficient if the wound magnetic core is treated in a circulating oven. One oven suitable for this treatment is made by Blue M of Blue Island, Ill., sold as model AGC7-1406G. Circulation of the air/steam mixture in the oven is believed to keep the temperature equal throughout the oven, and to bring air into the oven which contributes to the oxidation reaction. After the process is completed, the oven is cooled.

The core should be exposed to steam for a period of time sufficient to form an adequate layer of insulating material 40 for the intended core application. It has been observed that time periods of from 0.5 to 12 hours or longer may be used. Good results have been observed when the exposure time is 1 to 6 hours, more preferably 2 to 6 hours, and optimally 4 to 6 hours. The steam pressure should be sufficient to cause good penetration of the steam into the laminate assemblies. It has been found that steam pressures of about 0.1 to 0.25 psi, more preferably 0.25 to 0.5 psi, are sufficient for this purpose. However, other steam pressures may be used, as will be readily appreciated by those of skill in the art. For example, it is contemplated that steam pressures ranging from 0.1 to 100 psi or more may be used.

The pH of the steam has also been found to have an important effect in the efficiency of forming the insulating layers of the present invention. Better results are achieved when the feedwater for generating the steam has a basic pH, preferably in the range of pH 8 to 11, more preferably pH 9 to 11. These pH levels are achievable with water hardness levels of 20 to 80 ppm (mg/l) and combined sodium, calcium, potassium, magnesium levels of 75 to 200 ppm. One method to adjust feedwater pH is to expose the steam to salts which affect the pH. Representative examples of salts having this effect are calcium oxide, calcium hydroxide, calcium carbonate, magnesium oxide, magnesium hydroxide, and magnesium carbonate. These salts raise the pH of the feedwater and the resulting steam, making the generated steam somewhat basic. Other salts which might be used are oxides, hydroxides, salts which form hydrates of their associated ions, and other salts known to produce basic aqueous solutions. Of course, as will be appreciated by those of skill in the art, other methods to adjust pH may be used, such as the addition of bases to achieve the desired pH.

Preferably, the magnetic cores are annealed before or during the oxidative treatment which forms the insulating material on the surface of the metal ribbon. Annealing reduces the number of magnetic discontinuities in the magnetic core and can give the magnetic core desirable magnetic properties, as known to those of skill in the art. The presence of a full layer insulating metal oxide between core layers could interfere with the annealing process by introducing stress buildups. This is avoided by treating the cores to form the insulating material after the magnetic core has been wound and then during or after annealing. Because the process of the present invention produces metal oxide insulating materials at temperatures at or below the annealing temperature, this preferred sequence can be followed for most types of cores.

One embodiment which has produced good results is to anneal an amorphous metal alloy core (containing iron as the dominant metal) in air at a temperature of about 690° F. in the presence of a magnetic field to align the magnetic domains in the core. The oven temperature is then reduced to 580° F. to 625° F. before exposing the core to steam to form the iron oxide insulating layer. Even though annealing is done in air at a higher temperature than the temperature at which the insulating layer is formed by the process of the present invention, there are insufficient metal oxides present on the surfaces of the ribbon to provide dielectric insulation between the layers.

Another embodiment producing particularly good results is to treat an amorphous metal alloy core, having iron as the dominant metal, with steam and air while the core is being annealed. In other words, the insulating iron oxide coating formation and annealing take place simultaneously. The annealing temperature of the amorphous metal alloy will dictate the precise temperature for the treatment, as described above.

The coatings of the present invention also achieve superior performance by introducing desirable mechanical stresses or tensions on the underlying metal ribbon layer which improve performance. As known to those of skill in the art, power loss in soft magnetic cores has two components. The first component are eddy currents, which arise from voltages introduced in the substrate layers by flux variation. Eddy current losses are directly tied to the operational frequency of the induction coil, and play a minor role at low operational frequencies of 400 Hz or less, particularly for amorphous and nanocrystalline materials.

The second component of power loss results from the hysteresis effect, which is the amount of energy lost when the magnetic material repeats a magnetizing cycle. Stresses placed on a magnetic material can affect hysteresis losses, by affecting the magnetic domain ordering of the magnetic material. In particular, tensional stress has a positive effect on narrowing the hysteresis loop for positive magnetorestrictive materials such as amorphous metal alloys and nanocrystalline materials. The coatings of the present invention, when applied simultaneously with annealing of the metal ribbon, introduce such tension on the underlying metal ribbons. It is believed that differing thermal expansion characteristics of the iron oxides of the coating and the underlying metal ribbon contribute to this effect. Because the coating and the ribbon expand at different rates, particularly at typical core operating temperatures, tensions are introduced on the metal ribbon which improve its performance. For example, at low frequency operating conditions, where eddy current losses are insignificant, the simultaneously annealed and coated cores of the present invention exhibit improved performance in comparison to uncoated cores. See Table 3, below. This improved performance would not be expected simply from dielectric isolation of adjacent metal layers, and is attributable in part to stresses imparted to the metal ribbons which reduce hysteresis losses. Furthermore, the forces on the underlying metal ribbon is visually confirmed by fracture lines in the coating observable by microscopy.

EXAMPLES

The Examples which follow are illustrative of the ease of the process of the present invention, and the superior performance properties which result in cores produced by the present inventive process.

For the following Examples, power dissipation in C cores was measured by connecting a Volt-Amps-Watts (V-A-W) meter (Clark Hess Digital, New York, N.Y.) and a 2 MHz function generator (Maxtec International Corp, Chicago, Ill., model BK Precision 3011B) to a kilowatt amplifier (Model L6, Instruments, Inc., San Diego, Calif.) to control the output, shape and amplitude frequency and to measure the same. Sine waves with variable amplitude and frequency were then applied to the C cores through one of two possible multi-turn coils. The coils were wrapped around the C cores and connected to the output junctions of the kilowatt amplifier. Typical measurement conditions applied to the cores were dependent on the desired flux, and representative examples appear in Table 2.

TABLE 2

Electrical setup conditions for "C"core power measurement

| Frequency (kHz) | Excitation voltage (Volts) | Required flux level (KG) | Required number of turns |
|---|---|---|---|
| 0.4 | 14.6 | 2.0 | 50 T |
| 0.4 | 36.6 | 5.0 | 50 T |
| 0.4 | 72.6 | 10.0 | 50 T |
| 0.4 | 109 | 15 | 50 T |
| 1.0 | 3.6 | 2.0 | 5 T with step down transformerr |
| 1.0 | 9.26 | 5.0 | 5 T with step down transformerr |
| 10.0 | 36.6 | 2.0 | 5 T |
| 20.0 | 73 | 2.0 | 5 T |

*The above combinations are not unique. They were chosen to arrive at the selected flux level.

These levels were set using the Precision function generator by using the readout of the function generator, and the voltage reading display setting of the V-A-W meter. The V-A-W meter directly measures the core power loss and excitation current, using the power measurement and current measurement settings.

Figure 6:
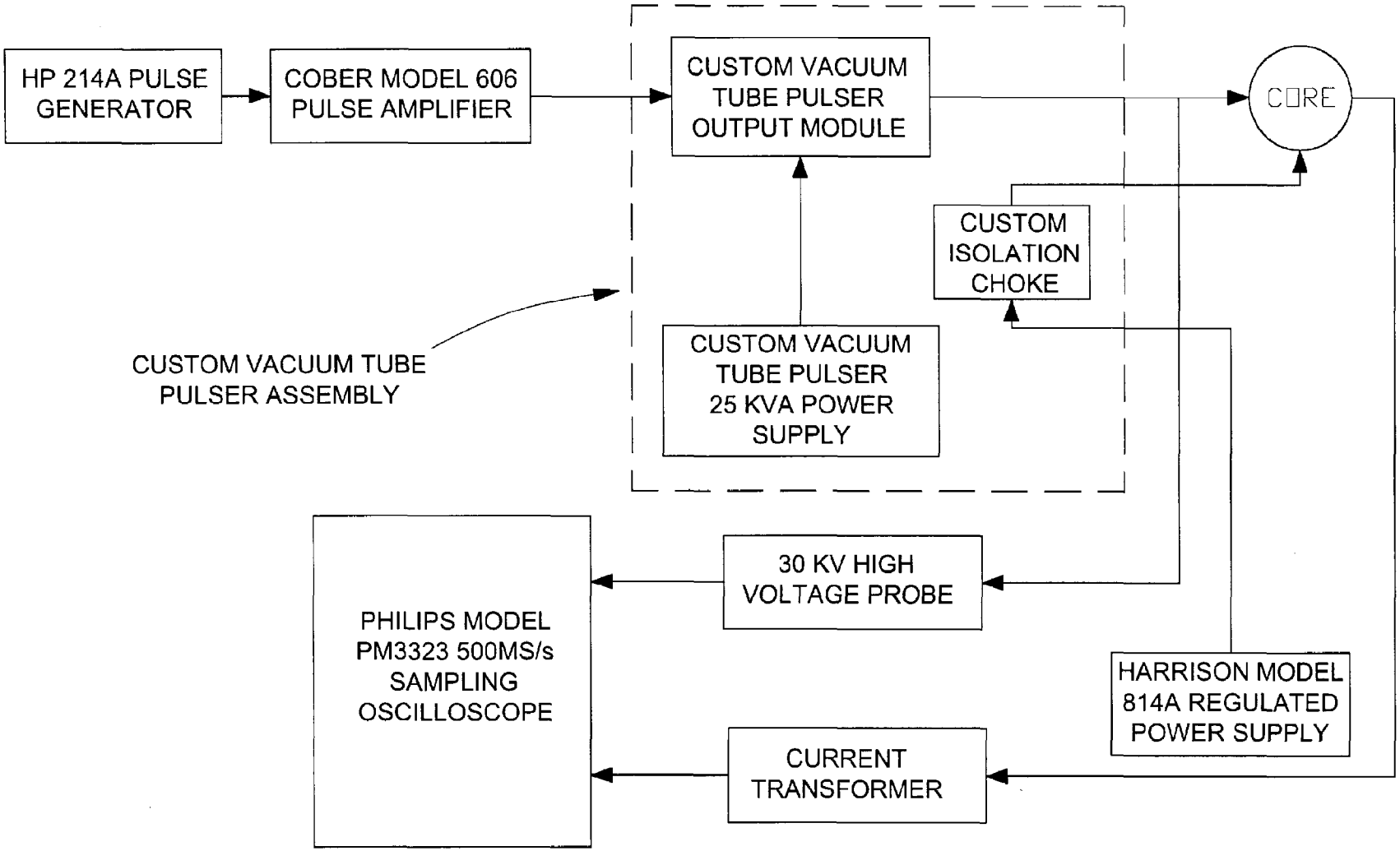
FIG. 6 is a schematic diagram of the pulse tester apparatus used to perform the toroid pulse testing.

To measure the power dissipation of pulsed toroids, a pulse generator (Hewlett Packard Model 214A), a high power pulse generator (Model 606, Cober Electronics, Stamford, Conn.) and a regulated power supply (model 814A, Harrison Laboratories, Berkley Heights, N.J.) were connected to a vacuum tube pulser to control its output rise time, duty cycle and amplitude for repetitive pulsing conditions. The vacuum tube pulser was connected to a 3 to 6 turn coil of high amperage cable, which was wrapped around the toroid being studied. The setup is isolated because of the high voltages being generated. An oscilloscope (Philips Model PM3323 500MS/s with 30 KV probe) was used to record the pulse shape, the core excitation profile and the integrated power response in memory. Typical measurement ranges were 1.5 to 3.0 microseconds for the pulse width, 15 to 20 ampere turns on the DC reset, with the pulser adjusted to achieve 1 to 4 Tesia of flux in the core. The pulse testing apparatus is illustrated schematically in FIG. 6.

Example 1

Decreased Power Losses

Wound cores of amorphous metal alloys such as METGLAS® 2605SA1 having approximately greater than 70% iron were simultaneously annealed and then treated with steam (pH 8) and air at 690° F. for 6 hours to form an iron metal oxide insulating material between the adjacent metal ribbon layers of the cores. Two groups of cores were formed. The first group consisted of cores weighing approximately 5 pounds each and the second group consisted of cores weighing approximately 1 pound each. Power loss data was normalized between the two groups by dividing the power loss by the weight of the core.

A second set of cores consisting of the two groups was made as above, but was not subjected to the steam and air treatment as described above. Consequently, this set of cores lacked the iron oxide insulating layer, and was used as a baseline to compare the power loss performance of the treated cores.

The normalized data is shown below in Table 3.

TABLE 3

Comparison of power loss of treated and untreated amorphous iron cores as a function of frequency
Power loss (watts/lb) for treated and untreated iron cores

| Frequency (kHz) | Untreated | Treated | % Improvement |
|---|---|---|---|
| 0.4 | 1.9 | 1.3 | 14 |
| 1.0 | 3.9 | 2.7 | 17 |
| 10.0 | 13 | 9.9 | 30 |
| 16.0 | 27 | 19 | 33 |
| 20.0 | 17 | 9.0 | 45 |

The data of Table 3 demonstrates that treating wound cores containing amorphous iron alloy with the method of the present invention generates cores that perform 14 to 45% better than untreated cores at high frequencies. Namely, power losses in the treated cores are decreased by from 14% to 45%. Further, the improvement in performance increases as the frequency increases, as shown above.

A similar experiment was performed with cores formed of nanocrystalline materials, such as 70% Fe, 9% B, 3% Nb, 2% Cu and small amounts of Mo, Co and S. These cores were annealed at 1000° F., cooled to room temperature, and then treated to form the iron oxide insulating layer as described above. The observed decrease in power losses for these cores in comparison to untreated nanocrystalline cores was similar to that observed for the amorphous metal alloy cores of Table 3.

Example 2

Comparison of Cores Treated With Steam and Air With Cores Treated With Magnesium Methylate in Pulse Tests Magnetic cores were formed from about 1 mil thick amorphous iron ribbon, such as METGLAS® 2605SA1, as toroidal pulse cores with 7.75 inches outside diameter, 4.25 inches inside diameter, and a 2-inch width. The cores were then either coated with magnesium methylate prior to winding, or treated with steam/air after winding to form an iron oxide insulating layer, or both, as described beneath in Table 4.

The cores were tested by applying 8.6 KV using very low frequency duty cycle, and the pulse energy calculated from the 3 μsec pulse width. The pulse data measurements included core power (the amount of power dissipated by the core), starting current, and saturation current. Pulse energy was then calculated from the area under the pulse curve multiplied by the voltage to give the joules of power. In all of the measurements, the lower the number, the better the core. Further, it is favorable for the starting current to be as close to the saturation current as possible. Test results are shown in Table 4.

TABLE 4

Pulse core data for cores treated with magnesium methylate and steam/air

| Test | Process | Core power (kW) | Starting current (amperes) | Saturation current (amperes) | Pulse energy (joules) |
|---|---|---|---|---|---|
| 1 | Oil impregnation, methylate, steam/air | 201 | 20 | 38 | 0.75 |
| 2 | Methylate, steam/air | 204 | 20 | 40 | 0.77 |
| 3 | Light resin impregnation, steam/air | 287 | 30 | 50 | 1.0 |
| 4 | Heavy resin impregnation, steam/air | 331 | 30 | 60 | 1.2 |
| 5 | Oil impregnation, steam/air | 196 | 22 | 32 | 0.7 |
| 6 | Magnesium methylate | 200 | 20 | 40 | 0.8 |

All of the cores shown in Table 4 were amorphous metal alloys containing iron as the dominant metal. For the core of Test 1, the amorphous metal ribbon was coated with a very thin coat of magnesium methylate, the ribbon was formed into a laminate core, and steam and air were applied by first annealing the cores at 690° F. for two hours then treating with steam (approximately pH 8) and air at 580° F. to 600° F. for approximately 6 hours, to also form an iron oxide insulating layer. The core was then impregnated with oil. Cores vibrate during the pulse tests, and the oil was added to help protect the core during the test. For the core of Test 2, the ribbon was coated with a very thin film of magnesium methylate, coiled into a laminate core, and the core was treated with steam/air as described in Example 1. The core of Test 3 was formed by coiling an amorphous metal ribbon into a laminate core and treating the core with steam and air as in Example 1. The treated core was then impregnated with a light resin. The core of Test 4 was formed in the same manner as the core of Test 3 and was then impregnated with a heavy resin. The core of Test 5 was formed by coiling an amorphous metal ribbon into a laminate core and then treating the core with steam and air as in Example 1. The core was then impregnated with oil, similar to the core of Test 1. The core of Test 6 was formed by coating an amorphous metal ribbon with a very thin layer of magnesium methylate and coiling the ribbon into a laminate core.

As shown above, the cores which were treated with steam and air to form iron oxide insulating layers generally performed as well or better in the pulse tests as the cores which were formed from ribbon coated with magnesium methylate. However, the insulating layers produced with the steam/air were made much faster and with far less expense than coating with thin layers of magnesium methylate.

Further, pulse cores coated only with magnesium methylate and then impregnated with resin broke apart during testing, and are not shown in Table 4 for that reason. Consequently, as the data demonstrates, there is more flexibility in the treatments that can be done with the pulse cores with insulating layers formed of native metal oxides such as iron oxide than with the pulse cores formed with magnesium methylate coatings. Coating the cores with resin, as in Test 3 and Test 4, simulates the binding agent processing that would be done prior to cutting the core to form a "C" core, for example. Even though the core power losses of the resin-impregnated cores prepared from cores which were previously treated with steam/air were 40 to 50% higher than the comparable cores which were not impregnated with resin, the benefits of impregnation may outweigh the increase in power dissipation in some applications where the increased rigidity is important.

Example 3

Performance vs. Processing Temperature

The following Table 5 shows the performance effects of processing amorphous metal cores having iron as the dominant metal under different temperature conditions. The cores used were all approximately five pounds in weight, with an approximate 2-inch wide strip width. All cores were treated with steam in the presence of air for 4 hours and annealed for 2 hours, except for the core simultaneously annealed and processed. The latter was annealed and steam treated simultaneously for 4 hours. An identical set of cores were created and annealed, but were not exposed to steam/air to form the iron oxide insulating coat. The power losses of each set of cores were measured, and are compared below.

TABLE 5

Relative performance of iron oxides coated on "C" cores compared to same uncoated configurations

| | Frequency (KHz) | | | |
|---|---|---|---|---|
| Processing conditions | 0.4 | 1.0 | 10.0 | 20.0 |
| 500° F. processing & 690° F. annealing | 9.0% | 43.9% | 21.1% | 19.8% |
| 550° F. processing & 690° F. annealing | −19.5% | 12.9% | −71.5% | −77.0% |
| 590° F. processing & 690° F. annealing | −5.7% | 22.2% | −53.1% | −57.3% |
| 625° F. processing & 690° F. annealing | −1.0% | 38.1% | 18.2% | 17.8% |
| 650° F. processing & 690° F. annealing | −4.3% | 31.2% | −12.7% | −18.5% |
| 690° F. simultaneous processing & annealing | 22.8% | 52.2% | 50.2% | 52.7% |

Core losses expressed as percentage improvement (reduction) compared to comparable uncoated configuration.

Figure 5:
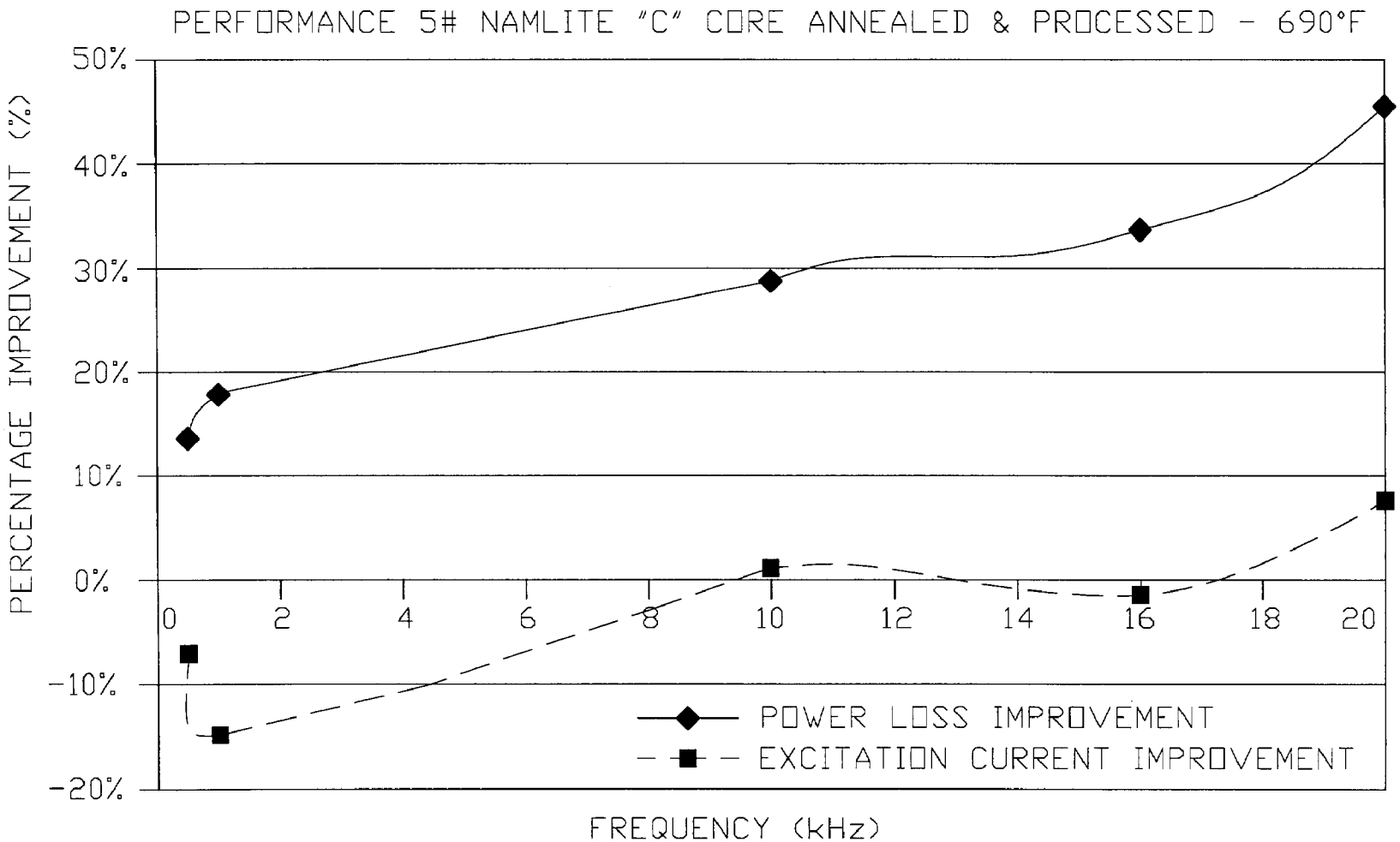
FIG. 5 is a comparative graph of the improved performance of coatings applied using steam generated from feedwater with a basic pH.

Table 5 reflects data taken from cores processed using pH enhanced steam, approximately pH 8 to 10, from a steam generator using feedwater from a reverse osmosis system. For comparison purposes, FIG. 5 (Table 3) shows the same core configuration processed from unpurified tap water as the feedwater having a pH of about 8.

Example 4

Shown below in Table 6 are comparisons of uncut toroidal cores of various weights. The cores were formed from amorphous metal alloys such as METGLAS 2605SA1. Iron is the dominant elemental metal. The cores were annealed at 690° F. for 2 hours, and then treated with steam/air at 580° F. to 600° F. for 2 to 6 hours. As can be seen from Table 6, cores having the insulative coatings of the present invention exhibited significantly decreased power losses, particularly for the higher 20 kHz frequency.

TABLE 6

Comparison of power losses uncut core configurations with/without steam

| Part Weight (lbs) | Low frequency - 400 Hz Untreated (watts/#) | Low frequency - 400 Hz Treated (watts/#) | High Frequency - 20 kHz Untreated (watts/#) | High Frequency - 20 kHz Treated (watts/#) | 400 Hz Imped-ance | 20 kHz Imped-ance |
|---|---|---|---|---|---|---|
| 0.83 | 2.2 | 2.9 | | | −31% | |
| 0.92 | 1.8 | 2.2 | 13 | 7.2 | −19% | 46% |
| 1.24 | 1.4 | 2.0 | | | −41% | |
| 2.68 | | | 29 | 5.8 | | 80% |
| 5.95 | 1.9 | 2.2 | 58 | 18 | −21% | 69% |
| 7.24 | 1.4 | 2.0 | 13 | 10 | −44 | 23 |

Example 5

METGLAS® 2605SA1 cores were annealed for two hours at 690° F., and then steam/air treated at 580° F. to 600° F. for 2, 4 or 6 hours. As shown below in Table 7, observed power losses generally decrease as the steam/air treatment time increases from 2 hours to 6 hours.

TABLE 7

Power dissipation (watts/#) at two frequencies versus processing time

| # | Processing Time (min) | Dissipation - 400 Hz | Dissipation - 20 kHz |
|---|---|---|---|
| 1 | 120 | 1.9 | 18 |
| 2 | 120 | 1.6 | 17 |
| 3 | 120 | 1.5 | 16 |
| 4 | 120 | 1.5 | 12 |
| 5 | 120 | 2.1 | 22 |
| 6 | 120 | 1.9 | 19 |
| 7 | 120 | 3.0 | 12 |
| 8 | 120 | 2.2 | 20 |
| 9 | 240 | 1.3 | 15 |
| 10 | 240 | 1.5 | 13 |
| 11 | 240 | 1.6 | 17 |
| 12 | 360 | | 10 |
| 13 | 360 | | 17 |

Results reflect normalized data of various core configurations with weights varying from slightly under 1 pound to slightly over 7 pounds.

Although the present invention and its advantages have been described in detail by referring to specific embodiments, it should be understood that various changes, substitutions and alterations can be made to such embodiments, as is know to those of skill in the art, without departing from the spirit and scope of the invention which is defined by the following claims.

The invention claimed is:

1. A method of providing dielectric isolation between adjacent metal layers of a laminated magnetic assembly, comprising:

providing a laminated magnetic assembly having a plurality of layers, wherein the plurality of layers are formed in part of iron;

oxidizing the plurality of layers to produce a coating comprising a mixture of iron oxides by exposing the plurality of layers to steam in the presence of oxygen to a temperature of at least 500° F., the resulting magnetic assembly having a resistivity of greater than about 60 ohm-cm; and adjusting the pH of the feedwater of the steam to above pH 7 by contacting the feedwater and a salt.

2. The method of claim 1, wherein in solution the salt forms a hydrate of its associated ion.

3. The method of claim 1, wherein the salt is selected from the group consisting of calcium oxide, calcium hydroxide, calcium carbonate, magnesium oxide, magnesium hydroxide, and magnesium carbonate.

4. The method of providing dielectric isolation between adjacent metal layers of a laminated magnetic assembly, comprising:

providing a laminated magnetic assembly having a plurality of layers, wherein the plurality of layers are formed in part of iron;

oxidizing the plurality of layers to produce a coating comprising a mixture of iron oxides by exposing the plurality of layers to steam in the presence of oxygen to a temperature of at least 500° F., the resulting magnetic assembly having a resistivity of greater than about 60 ohm-cm; and adjusting the pH of the feedwater of the steam to from about 8 to about 11 by contacting the feedwater and a salt.

5. The method of claim 4, wherein in solution the salt forms a hydrate of its associated ion.

6. The method of claim 4, wherein the salt is selected from the group consisting of calcium oxide, calcium hydroxide, calcium carbonate, magnesium oxide, magnesium hydroxide, and magnesium carbonate.

7. A method of providing dielectric isolation between adjacent metal layers of a laminated magnetic assembly, the method comprising the steps of:

providing a laminated magnetic assembly having a plurality of layers, wherein the plurality of layers are formed in part of iron;

exposing the plurality of layers to steam in the presence of oxygen at a temperature of at least 500° F., the resulting magnetic assembly having a resistivity of greater than about 60 ohm-cm;

contacting the feedwater for the steam with a salt to adjust the feedwater to pH to above pH 7.

8. The method of claim 7 further comprising the step of adjusting the pH of the feedwater for the steam to a ph of from about 8 to about 11.

9. The method of claim 7 wherein the salt in solution with the feedwater forms a hydrate of its associated ion.

10. The method of claim 7, wherein the salt is selected from the group consisting of calcium oxide, calcium hydroxide, calcium carbonate, magnesium oxide, magnesium hydroxide, and magnesium carbonate.

* * * * *